US005130212A

United States Patent [19]

Morimoto et al.

[11] Patent Number: 5,130,212

[45] Date of Patent: Jul. 14, 1992

[54] PROCESS FOR PRODUCING SILVER HALIDE PHOTOGRAPHIC MATERIAL

[75] Inventors: Isamu Morimoto; Kaoru Hattori; Koichi Ueda; Hiroyuki Ushiroyama, all of Hino, Japan

[73] Assignee: Konica Corporation, Tokyo, Japan

[21] Appl. No.: 555,294

[22] Filed: Jul. 19, 1990

[30] Foreign Application Priority Data

Jul. 24, 1989 [JP] Japan ..... 1-192229

[51] Int. Cl.[5] ..... G03C 1/015

[52] U.S. Cl. ..... 430/569; 430/577; 430/599; 430/608

[58] Field of Search ..... 430/569, 577, 599, 608

[56] References Cited

U.S. PATENT DOCUMENTS 3,759,713 9/1973 Florens et al. ..... 430/577
3,953,216 4/1976 Hinata et al. ..... 430/577
4,582,786 4/1986 Ikeda et al. ..... 430/577

FOREIGN PATENT DOCUMENTS 285308 10/1988 European Pat. Off. .

*Primary Examiner*—Charles L. Bowers, Jr.
*Assistant Examiner*—Janet C. Baxter
*Attorney, Agent, or Firm*—Jordan B. Bierman

[57] ABSTRACT

A process for producing a silver halide photographic material that has at least one silver halide emulsion layer on a support, in which process at least 10 mg of a calcium salt per mole of silver halide is added during the period from the completion of physical ripening a silver halide emulsion to the completion of its chemical ripening together with at least one compound represented by the following general formula (I) and at least one compound represented by the following general formula (II):

(I)

where $R_1$ is a hydrogen atom or an alkyl group; $R_2$ and $R_3$ which may be the same or different are each a substituted or unsubstituted alkyl group; $A_1$–$A_6$ are each a hydrogen atom, an alkyl group, an alkoxy group, a halogen atom or a phenyl group, provided that adjacent atoms or groups may combine to form a ring; X is an anion; and n is 0 or 1, provided that n =0 when an intramolecular salt is formed.

4 Claims, No Drawings

PROCESS FOR PRODUCING SILVER HALIDE PHOTOGRAPHIC MATERIAL

BACKGROUND OF THE INVENTION

This invention relates to a process for producing a silver halide photographic material. More particularly, the present invention relates to a process for producing a silver halide photographic material having improved sensitivity, keeping quality and developability.

The performance requirements of silver halide photographic materials (hereinafter sometimes referred to simply as "light-sensitive materials") have recently become versatile and ever stringent. A particularly strong need exists for the development of light-sensitive materials that have high sensitivity, that provide high image quality and that have good keeping quality.

Spectral sensitization with cyanine dyes is a well-known technique that has customarily been practiced to sensitize light-sensitive materials. Combinations of specific cyanine dyes either with themselves or with non-dye compounds are described in many prior patents including dye compounds are described in many prior patents including Examined Japanese Patent Publication Nos. 34535/1979 and 38936/1981 and Unexamined Published Japanese Patent Application No. 153826/1983.

These prior art techniques are capable of improving the spectral sensitivity of light-sensitive materials to some extent but on the other hand, they cause deleterious effects on development and fail to achieve desired improvement in practical sensitivity, or they reduce the contrast to cause deterioration of image quality. Further, they impair the raw stock stability of light-sensitive materials. Thus, further studies have been necessary to develop light-sensitive materials that have satisfactory levels of sensitivity and image quality.

The recent advances in the technology of rapid processing of light-sensitive materials have been remarkable and at the same time, photographic process control has become increasingly simplified. This is in order to save the labor and cost involved in maintenance and control of processing steps, and practices currently adopted to meet this need include low replenishment rate of processing solutions, extension of the term for which processing solutions are used without replenishment, and adopting the same conditions for processing light-sensitive materials that have previously been processed under different conditions.

In response to these practices for processing light-sensitive materials in a faster and simpler way, methods have been taken to reduce their dependency upon development and subsequent processing. For instance, Unexamined Published Japanese Patent Application No. 39928/1975 teaches the use of hydroquinones in light-sensitive materials, and Unexamined Published Japanese Patent Application No. 19739/1982 proposes the use of 1-phenyl-3-pyrazolidones instead of hydroquinones. Both of these techniques aim at reducing the processing dependency of light-sensitive materials by incorporating developing agents therein, so that they will be less subject to the adverse effects of variations in processing conditions.

However, if developing agents are incorporated in silver halide photographic emulsion layers or layers adjacent thereto, they will deteriorate the photographic characteristics of the light-sensitive materials during pre-exposure storage, causing a serious problem such as extensive fogging.

SUMMARY OF THE INVENTION

An object, therefore, of the present invention is to provide a process for producing a silver halide photographic material that has high sensitivity to light and which also has good developability in rapid development.

Another object of the present invention is to provide a process for producing a silver halide photographic material having high aging stability.

These objects of the present invention can be attained by a process for producing a silver halide photographic material that has a least one silver halide photographic emulsion layer on a support, in which process at least 10 mg of a calcium salt per mole of silver halide is added during the period from the completion of physical ripening of a silver halide emulsion to the completion of its chemical ripening together with at least one compound represented by the following general formula (I) and at least one compound represented by the following general formula (II):

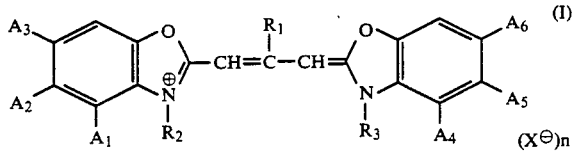

(I)

where $R_1$ is a hydrogen atom or an alkyl group; $R_2$ and $R_3$ which may be the same or different are each a substituted or unsubstituted alkyl group; $A_1$–$A_6$ are each a hydrogen atom, an alkyl group, an alkoxy group, a halogen atom or a phenyl group, provided that adjacent atoms or groups may combine to form a ring; X is an anion; and n is 0 or 1, provided that n=0 when an intramolecular salt is formed;

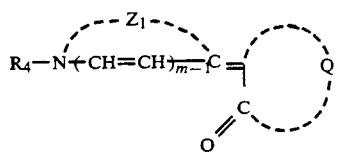

(II)

where $Z_1$ is the group of non-metallic atoms necessary to form a 5- or 6-membered hetero ring; Q is the group of non-metallic atoms necessary to form a 5-membered nitrogenous hetero ring; $R_4$ is an alkyl group or a substituted alkyl group; and m is 1 or 2.

DETAILED DESCRIPTION OF THE INVENTION

In the general formula (I), $R_1$ is a hydrogen atom or an alkyl group having 1 or 2 carbon atoms (e.g. methyl or ethyl), and $R_2$ and $R_3$ which may be the same or different are each a substituted or unsubstituted alkyl group having 1–4 carbon atoms, as exemplified by an alkyl group (e.g. methyl, ethyl, propyl or butyl), a hydroxyalkyl group (e.g. 2-hydroxyethyl or 3-hydroxypropyl), an aralkyl group (e.g. benzyl or 2-phenylethyl), a carboxyalkyl group (e.g. 2-carboxyethyl, 3-carboxypropyl or 4-carboxybutyl), a sulfoalkyl group (e.g. 2-sulfoethyl, 3-sulfopropyl, 3-sulfobutyl, 4-sulfobutyl, 2-(3-sulfopropoxy)ethyl, 2-hydroxy-3-sulfopropyl, or 3-sulfopropoxyethoxyethyl).

In the general formula (I), $A_1$–$A_6$ are each an alkyl group or an alkoxy group, and this alkyl group or the alkyl portion of said alkoxy group may be exemplified by alkyls having 1–4 carbon atoms such as methyl, ethyl, butyl, methoxy, ethoxy and butoxy. If $A_1$–$A_6$ represent a halogen atom, it may be exemplified by chlorine, bromine and iodine. As already mentioned, $A_1$–$A_6$ are such that adjacent atoms or groups may combine to form a ring such as a naphtho ring.

In the general formula (II), $Z_1$ is the group of non-metallic atoms necessary to form a 5- or 6-membered hetero ring such as a thiazole, selenazole, oxazole, benzothiazole, benzoselenazole, benzoxazole, naphthothiazole, naphthoselenazole, naphthoxazole, pyridine or quinoline ring. These hetero rings may have substituents such as a halogen atom (e.g. Cl or Br), an alkyl group, preferably, an alkyl group having 1–4 carbon atoms (e.g. methyl, ethyl or n-propyl), a halogenated alkyl group (e.g. trifluoromethyl), an alkoxy group, preferably, an alkoxy group having 1–4 carbon atoms (e.g. methoxy, ethoxy, n-propyloxy), a hydroxyl group, and an aryl group (e.g. phenyl).

In the general formula (II), Q denotes the group of non-metallic atoms necessary to form a 5-membered nitrogenous hetero ring such as a rhodanine, thichydantoin, thioxazolidinedione, thioselenazolidinedione ring. Those hetero rings may have substituents which are preferably selected from among alkyl groups having 1–4 carbon atoms (e.g. methyl, ethyl, n-propyl, 2-hydroxyethyl, 2-hydroxyethyloxyethyl, 2-methoxyethyl, 2-acetoxyethyl, carboxymethyl, 2-carboxyethyl, 3-carboxypropyl, 4-carboxybutyl, 2-sulfoethyl, 3-sulfopropyl, 3-sulfobutyl, 4-sulfobutyl, benzyl, phenethyl and n-butyl), aryl groups (e.g. phenyl and p-sulfophenyl), and pyridyl groups (e.g. 2-pyridyl, 3-pyridyl and methyl-2-pyridyl).

In the general formula (II), $R_4$ is an alkyl group or a substituted alkyl group and may be exemplified by alkyl groups having 1–18, preferably 1–7, more preferably 1–4 carbon atoms (e.g. methyl, ethyl, propyl, isopropyl, butyl, isobutyl, hexyl, octyl, dodecyl and octadecyl), substituted alkyl groups such as an aralkyl group (e.g. benzyl or 2-phenylethyl), a hydroxyalkyl group (e.g. 2-hydroxyethyl or 3-hydroxypropyl), a carboxyalkyl group (e.g. 2-carboxyethyl, 3-carboxypropyl, 4-carboxybutyl or carboxymethyl), an alkoxyalkyl group (e.g. 2-methoxyethyl or 2-(2-methoxyethoxy)ethyl), a sulfoalkyl group (e.g. 2-sulfoethyl, 3-sulfopropyl, 3-sulfobutyl, 4-sulfobutyl, 2-(3-sulfopropoxy)-ethyl, 2-hydroxy-3-sulfopropyl or 3-sulfopropoxyethoxyethyl), a sulfatoalkyl group (e.g. 3-sulfatopropyl or 4-sulfatobutyl), a hetero ring substituted alkyl group (e.g. 2-(pyrrolidin-2-on-1-yl)ethyl or tetrahydrofurfuryl), 2-acetoxyethyl, carbomethoxymethyl, 2-methanesulfonylaminoethyl and allyl groups.

The following are non-limiting examples of the compounds represented by the general formulas (I) and (II).

ILLUSTRATIVE COMPOUNDS

I-1

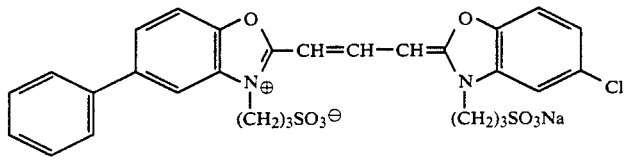

I-2

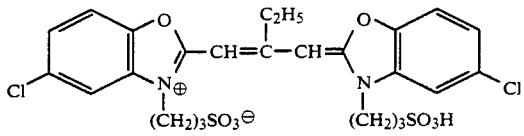

I-3

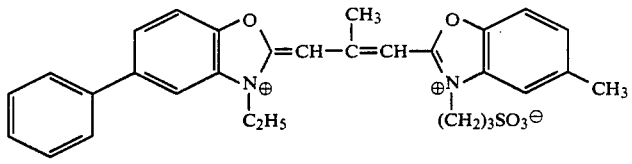

I-4

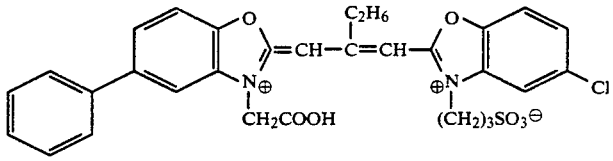

I-5

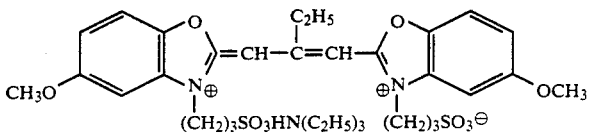

-continued
I-6
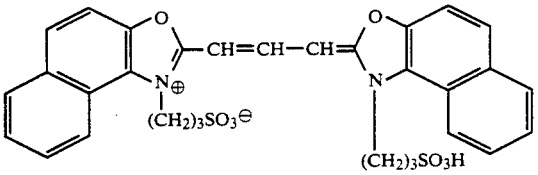
I-7
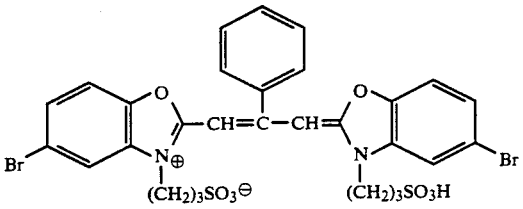
I-8
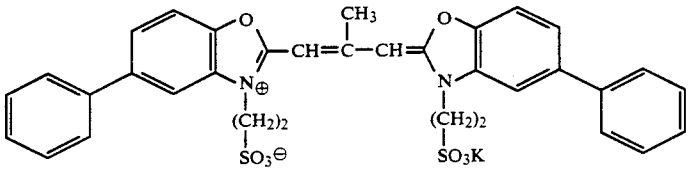
II-1
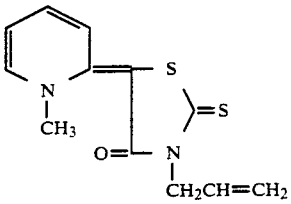
II-2
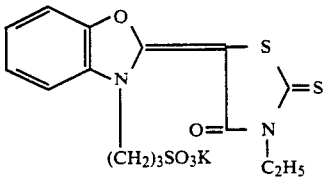
II-3
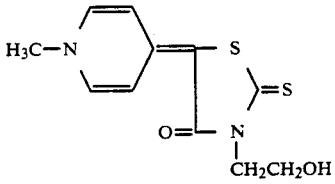
II-4
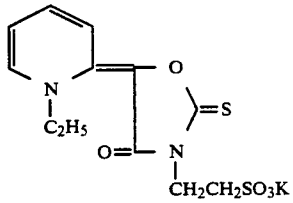
II-5
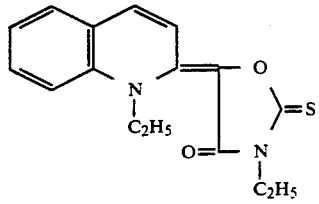

-continued
II-6
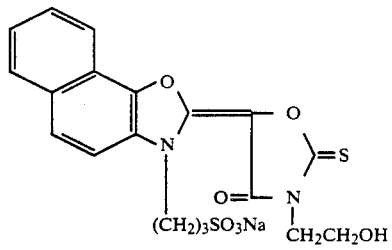
II-7
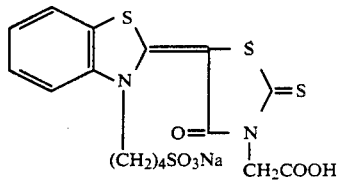
II-8
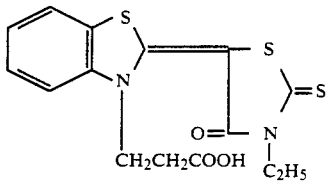
II-9
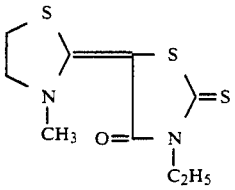
II-10
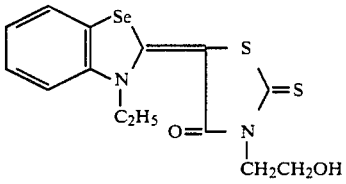
II-11
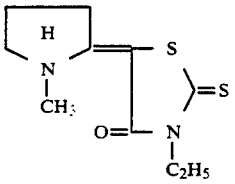
II-12
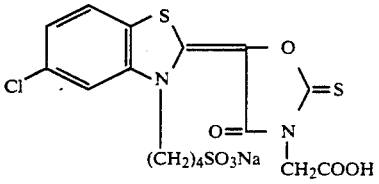

-continued
II-13
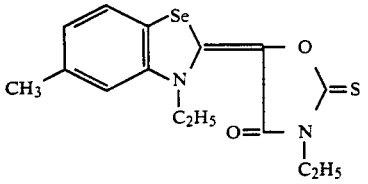
II-14
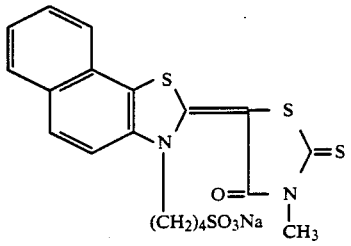
II-15
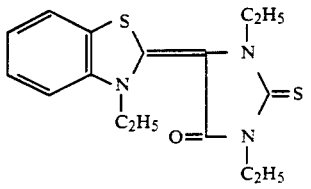
II-16
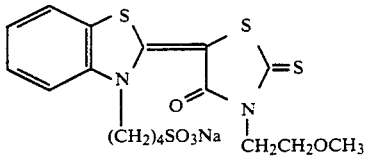
II-17
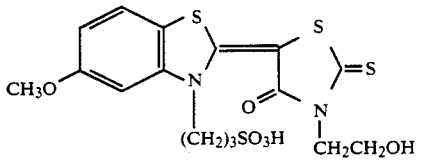
II-18
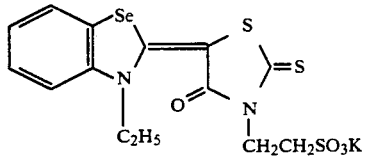
II-19
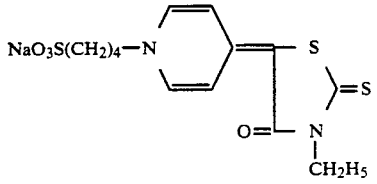

-continued
II-20
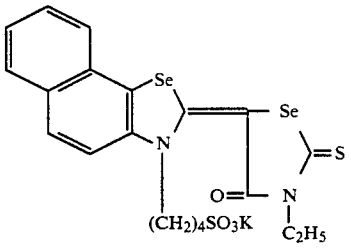
II-21
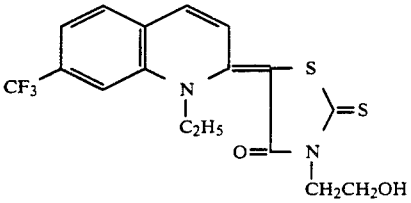
II-22
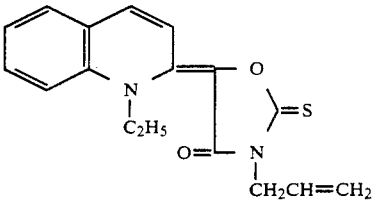
II-23
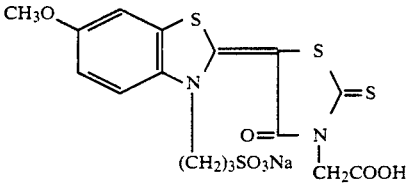
II-24
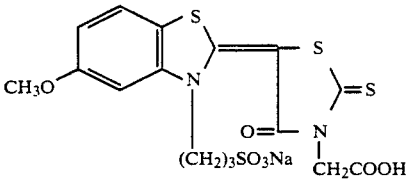
II-25
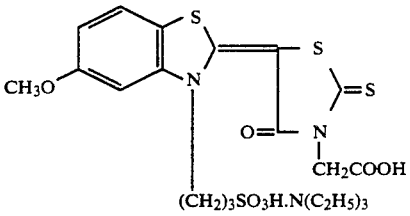
II-26
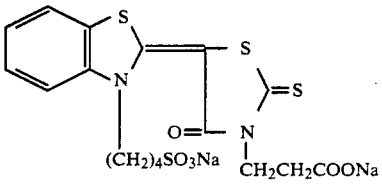

-continued

II-27

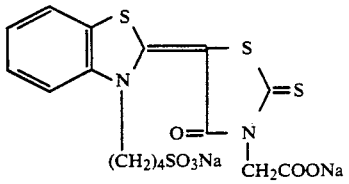

II-28

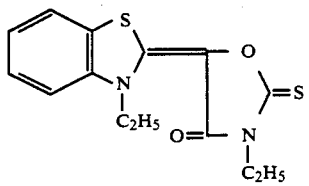

The compounds (I) and (II) which are to be used as sensitizing dyes in the present invention can be easily synthesized by known methods such as those described in F. M. Hamer, "Heterocyclic Compounds—Cyanine Dyes and Related Compounds", Chapters IV, V and VI, John Wiley and Sons, Inc., New York and London, 1964, and D. M. Sturmer, "Heterocyclic Compounds—Special Topics in Heterocyclic Chemistry", Chapter VIII, Section IV, John Wiley and Sons, Inc., New York and London, 1977.

The calcium salt to be used in the present invention is a water-soluble salt and its crystal may assume any hydrated form. Specific examples of the calcium salt that can be used include calcium chloride, calcium bromide, calcium iodide, calcium nitrate and calcium acetate. Among these, calcium chloride and calcium bromide are particularly preferred.

The calcium salt may be used in an amount of at least 10 mg per mole of silver halide, with the range of 50–1,000 mg being preferred. It may be added at any time during the period from the completion of physical ripening of a silver halide emulsion to the completion of its chemical ripening. For example, it may be added at the time of completion of physical ripening, completion of chemical ripening, or any time therebetween. Preferably, the calcium salt is added at the time of start of chemical ripening. The calcium salt may be added to the emulsion either directly or after being dissolved in a suitable solvent such as water. The calcium salt may be added either singly or in combination with other additives.

In order to incorporate the compound of the general formula (I) or (II) in a silver halide emulsion, it may be directly dissolved in the coating solution for an emulsion layer. Alternatively, it may be added in the form of a solution in water or organic solvents such as methanol, ethanol and acetone which may be used either on their own or as admixtures. If necessary, these compounds may also be incorporated in layers such as protective layers or intermediate layers that are adjacent to silver halide emulsion layers in amounts that will cause no adverse effects on the photographic performance of light-sensitive materials.

The amount in which the compounds of the general formulas (I) and (II) are incorporated in silver halide emulsion layers during the process of the present invention will vary with the type of silver halide emulsions and the type of those compounds. Typically, they are used in amounts ranging from 5 mg to 1,000 mg per mole of silver halide.

The silver halide emulsions to be used in the practice of the present invention can be prepared by various methods including an acid method, a neutral method, an alkali method and an ammoniacal method. Various precipitation methods can also be used and they include normal precipitation, reverse precipitation, double-jet precipitation, pAg controlled double-jet method, and a conversion method.

The silver halides to be used in the present invention may have any composition such as silver chloride, silver bromide, silver iodobromide or silver iodochloride. The advantages of the present invention will be attained most effectively with a silver halide composition having a silver iodide content of no more than 5 mol %.

The formation of silver halide grains or the physical ripening of a silver halide emulsion for use in the present invention may be carried out in the presence of a cadmium salt, a zinc salt, a lead salt, a thallium salt, an iridium salt or an iridium complex salt, a rhodium salt or a rhodium complex salt, or an iron salt or an iron complex salt.

The emulsion to be used in the present invention may have various photographic additives incorporated before or after the process of its physical or chemical ripening. Known photographic additives may be found in Research Disclosure (RD) No. 17643 (December 1978) and RD No. 18716 (November 1979).

The names of the useful additive compounds shown in these two issues of Research Disclosure are listed below together with the pages on which they appear.

| | RD-17643 | | RD-18716 | |
|---|---|---|---|---|
| Additive | page | description | page | description |
| Chemical sensitizer | 23 | III | 648 | upper right column |
| Sensitizing dye | 23 | IV | 648<br>649 | right column<br>left column |
| Development accelerator | 29 | XXI | 648 | upper right column |
| Antifoggant | 24 | VI | 649 | lower right column |
| Stabilizer | 24 | VI | 649 | lower right column |
| Color stain preventing agent | 25 | VII | 650 | left and right columns |
| Image stabilizer | 25 | VII | | |
| UV absorber | 25–26 | VIII | 649<br>650 | right Column<br>left column |
| Filter dye | 25–26 | VIII | 649<br>650 | right column<br>left column |
| Brightener | 24 | V | | |
| Hardener | 26 | X | 651 | right column |
| Coating aid | 26–27 | XI | 650 | right column |

-continued

| Additive | RD-17643 page | RD-17643 description | RD-18716 page | RD-18716 description |
|---|---|---|---|---|
| Surfactant | 26-27 | XI | 650 | right column |
| Plasticizer | 27 | XII | 650 | right column |
| Slip agent | 27 | XII | | |
| Antistatic agent | 27 | XII | 650 | right column |
| Matting agent | 28 | XVI | 650 | right column |
| Binder | 26 | IX | 651 | right column |

Various supports can be used to produce a sliver halide photographic material according to the process of the present invention and they include paper, glass, cellulose acetate, cellulose nitrate, polyesters, polyamides, polystyrene and polypropylene, as well as two or more substrates bonded together such as paper laminated with polyolefins (e.g. polyethylene and polypropylene).

The silver halide photographic material produced by the process of the present invention may be developed by means of various developing agents and a suitable developing agent can be selected in accordance with the specific type of the photographic material produced. Exemplary developing agents that can be used include: HC—(CH=CH)$_n$—OH type (e.g. hydroquinone); HO—(CH=CH)$_n$—NH$_2$ type (e.g. ortho- or para-aminophenol or aminopyrazolone); and H$_2$N—(CH=CH)$_2$—NH$_2$ type (e.g. 4-amino-2-methyl-N,N-diethylaniline).

Other developing agents that can be used effectively in the present invention are described in T. H. James, ed., The Theory of the Photographic Process, 4th ed., pp. 291-334, and Journal of the American Chemical Society, 73, 3,100 (1951).

The developing agents described above may be used either on their own or as admixtures but they are preferably used as admixtures. The developer used to develop the light-sensitive material produced by the process of the present invention may contain a preservative selected from among sulfites such as sodium sulfite and potassium sulfite, and the use of such compounds will cause no deleterious effects on the intended objects of the present invention. Hydroxylamines and hydrazide compounds may also be used as preservatives. If desired, pH adjustments can be made and buffering action provided by using caustic alkalies, alkali carbonates or amines as in the case of common black-and-white developers. Other additives that may be incorporated as required include: inorganic development restrainers such as potassium bromide; organic development restrainers such as benzotriazole; metal ion sequestrants such as ethylenediaminetetraacetic acid; development accelerators such as methanol, ethanol, benzyl alcohol and polyalkylene oxide; surfactants such as sodium alkylarylsulfonates, natural saponin, sugars and alkyl esters thereof; hardeners such as glutaraledhyde, formaldehyde and glyoxal; and ionic strength modifiers such as sodium sulfate.

The developer used in the present invention may contain alkanolamines or glycols as organic solvents.

The developer of the composition described may have a pH of 9-13, with the range of 10-12 being preferred from the viewpoints of preservability and photographic characteristics.

The silver halide photographic material produced by the process of the present invention can be processed under various conditions. The processing temperature, for example, the development temperature is preferably not higher than 50° C., more preferably within the range of 30°-40° C. The development time is typically set to be no longer than 2 min, and particularly good results are often achieved by completing the development within 30 sec. Other processing steps such as washing, stopping, stabilizing and fixing may also be performed under usual conditions. If desired, prehardening, neutralizing and any other necessary steps may be included. Of course, these additional steps may be omitted depending on the case. Development may be carried out either manually (e.g. tray development or rack development) or mechanically (e.g. roller development or hanger development).

The following example is provided for the purpose of further illustrating the present invention but is in no way to be taken as limiting.

EXAMPLE

To a silver iodobromide emulsion containing 1 mol % AgI and suitable amounts of iridium and rhodium, ammonium thiocyanate, chloroauric acid and sodium thiosulfate were added. The resulting mixture was chemically sensitized by adding calcium salts in the amounts indicated in Table 1.

Ten minutes before the completion of chemical sensitization, spectral sensitizing dyes of the general formulas (I) and (II) were added either individually or in combination in the amounts indicated in Table 1. Thereafter, stabilizers (4-hydroxy-6-methyl-1,3,3*a*-7-tetrazaindene and 1-phenyl-5-mercaptotetrazole), a surfactant (isopropyl naphthalenesulfonate), a physical property modifying agent (polyethyl acrylate), a brightener (see below) and a processability improving agent (1-phenyl-3-pyrazolidone) were added in suitable amounts.

Brightener

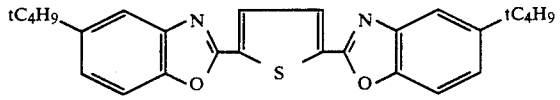

A solution containing 10 g of this compound dissolved in 200 ml of cresyl diphenyl phosphate and 100 ml of ethyl acetate was mixed with 2,000 ml of a 10% aqueous gelatin solution containing 5 g of isopropyl naphthalenesulfonate at ca. 50° C. After dispersing with a homogenizer, the mixture was worked up with pure water to a total volume of 3,000 ml. The resulting solution was added in an amount of 1,000 ml per mole of silver halide.

The emulsion thus prepared was mixed with formaldehyde and tetraquis(vinylsulfonylmethyl)methane as hardeners and thereafter applied onto a subbed polyethylene-coated paper support. Simultaneously with the application of the emulsion, a gelatin solution containing a surfactant and a matting agent was applied and dried to form a protective layer with a gelatin deposit of 1.7 g/m. The thus fabricated sample of photographic material had a silver content of 1.4 g/m$^2$ and the gelatin content in the two layers was 3.8 g/m$^2$.

Evaluation of Sensitivity and Developability

The samples thus fabricated were exposed for $10^{-6}$ sec under a xenon flash light source through an optical wedge and developed with a developer of the formula shown below using an automatic processor GR-26 (Konica Corp.).

Subsequently, the developed samples were fixed, washed with water and dried. The development temperature was 38° C. and the development time was either 20 sec or 40 sec.

| Developer | |
|---|---|
| Diethylene glycol | 40 g |
| Sodium sulfite | 50 g |
| Sodium hydroxide | 10 g |
| 1-Phenyl-3-pyrazolidone | 1 g |
| Hydroquinone | 25 g |
| Sodium carbonate | 20 g |
| Potassium bromide | 3 g |
| Water to make | 1,000 ml |

The reflection density of each of the processed samples was measured with a Konica Digital Densitometer Model PDA-65 (Konica Corp.) and their photographic characteristics were evaluated from the constructed characteristic curves. The results are shown in Table 1, in which "sensitivity" means relative sensitivity that was determined as the reciprocal of the amount of exposure necessary to provide a photographic density of 1.0 and which was expressed in terms of relative values, with the value for comparative sample No. 1 being taken as 100.

Developability was evaluated in terms of sensitivity ratio, $S_2/S_1$, where $S_1$ was the sensitivity attained by 20-sec development and $S_2$ was the sensitivity attained by 40-sec development. For the definition of "sensitivity", see above.

The keeping quality of the samples was evaluated by the following procedure: the freshly prepared samples were humidified at 23° C.×55% r.h., sealed hermetically, and thereafter left to stand in a hot (55° C.) atmosphere for 3 days to perform a forced aging test. Both of these test samples and comparative samples that were simply left to stand at 23° C.×55% r.h. were subsequently processed as described above except that they were not exposed. The increase in the fog density of each sample was measured with a densitometer. The results are also shown in Table 1.

TABLE 1

| | No. | Compound (I) No. | Compound (I) Amount, mg/mol Ag | Compound (II) No. | Compound (II) Amount, mg/mol Ag | Calcium salt Compound | Calcium salt Amount mg/mol Ag | Sensitivity $S_1$ (20-secdevelopment) | Sensitivity $S_2$ (40-secdevelopment) | Developability $S_2/S_1$ | Fog upon forced aging |
|---|---|---|---|---|---|---|---|---|---|---|---|
| Comparison | 1 | I-5 | 150 | — | — | — | — | 100 (Standard) | 137 | 1.37 | 0.05 |
| Comparison | 2 | I-5 | 205 | — | — | — | — | 107 | 140 | 1.31 | 0.06 |
| Comparison | 3 | I-5 | 150 | II-13 | 90 | — | — | 97 | 157 | 1.62 | 0.05 |
| Comparison | 4 | I-5 | 150 | — | — | $CaCl_2$ | 220 | 117 | 128 | 1.09 | 0.04 |
| Invention | 5 | I-5 | 150 | II-13 | 90 | $CaCl_2$ | 220 | 160 | 182 | 1.14 | 0.02 |
| Invention | 6 | I-5 | 150 | II-13 | 90 | $CaCl_2$ | 330 | 161 | 184 | 1.14 | 0.02 |
| Invention | 7 | I-5 | 150 | II-13 | 90 | $CaBr_2$ | 220 | 157 | 179 | 1.14 | 0.01 |
| Invention | 8 | I-5 | 150 | II-1 | 90 | $CaCl_2$ | 220 | 156 | 177 | 1.13 | 0.02 |
| Invention | 9 | I-5 | 230 | II-13 | 90 | $CaCl_2$ | 220 | 166 | 188 | 1.13 | 0.03 |
| Comparison | 10 | I-2 | 150 | — | — | — | — | 102 | 139 | 1.36 | 0.05 |
| Comparison | 11 | I-2 | 150 | II-3 | 90 | — | — | 96 | 159 | 1.66 | 0.05 |
| Comparison | 12 | I-2 | 150 | — | — | $CaBr_2$ | 220 | 117 | 132 | 1.13 | 0.04 |
| Invention | 13 | I-2 | 150 | II-3 | 90 | $CaBr_2$ | 220 | 163 | 181 | 1.11 | 0.02 |
| Invention | 14 | I-2 | 150 | II-3 | 150 | $CaBr_2$ | 220 | 168 | 180 | 1.07 | 0.03 |
| Invention | 15 | I-8 | 150 | II-3 | 90 | $CaBr_2$ | 220 | 160 | 180 | 1.13 | 0.02 |
| Invention | 16 | I-2 | 150 | II-3 | 90 | $CaBr_2$ | 330 | 157 | 176 | 1.12 | 0.01 |

As is clear from Table 1, the samples containing spectral sensitizing dyes (I) and (II) in combination but which did not contain calcium salts had high sensitivity in the 40-sec development but they experienced desensitization in the initial period (20-sec sensitization). On the other hand, the samples containing sensitizing dyes (I) in combination with calcium salts had improved initial developability but they experienced desensitization in the 40 sec development. All of these comparative samples had poor keeping quality and experienced extensive fog.

The samples in which calcium salts were used in combination with spectral sensitizing dyes (I) and (II) in accordance with the present invention exhibited excellent photographic characteristics in that they had satisfactory sensitivity and developability and that they could be stored in a pre-exposure stage without fogging.

The process of the present invention provides a silver halide photographic material having excellent photographic characteristics in terms of sensitivity and developability. The photographic material also has good raw stock stability.

What is claimed is:

1. In a process for producing a sliver halide photographic material that has at least one silver halide photographic emulsion layer on a support, the improvement wherein at least 10 mg of a water-soluble calcium salt per mole of silver halide is added during the period from the completion of physical ripening of a silver halide emulsion to the completion of its chemical ripening and at least one compound represented by the following general formula (I) and at least one compound represented by the following general formula (II) is individually added during the period from the completion of physical ripening to before coating, said formula (I) and said formula (II) being added to the silver halide emulsion, or to either an adjacent protective layer or an adjacent intermediate layer,

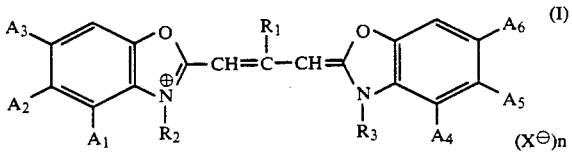

(I)

where $R_1$ is a hydrogen atom or an alkyl group; $R_2$ and $R_3$ which may be the same or different are each a substituted or unsubstituted alkyl group; $A_1$–$A_6$ are each a hydrogen atom, an alkyl group, an alkoxy group, a halogen atom or a phenyl group, provided that adjacent atoms or groups may combine to form a ring; X is an anion; and n is 0 or 1, provided that n=0 when an intramolecular salt is formed;

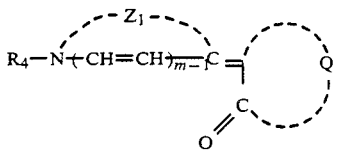

(II)

where $Z_1$ is the group of non-metallic atoms necessary to form a 5- or 6-membered hetero ring; Q is the group of non-metallic atoms necessary to form a 5-membered nitrogenous hetero ring; $R_4$ is an alkyl group or a substituted alkyl group; and m is 1 or 2.

2. A process according to claim 1 wherein said calcium salt is at least one member of the group consisting of calcium chloride, calcium bromide, calcium iodide, calcium nitrate and calcium acetate.

3. A process according to claim 1 wherein said calcium salt is contained in an amount of 50–1,000 mg per mole of silver halide.

4. A process according to claim 1 wherein each of the compounds represented by the general formulas (I) and (II) is contained in an amount of 5–1,000 mg per mole of silver halide.

* * * * *